US009916807B2

(12) United States Patent
Kim et al.

(10) Patent No.: US 9,916,807 B2
(45) Date of Patent: Mar. 13, 2018

(54) OUTPUT CIRCUIT AND SWITCHING CIRCUIT OF DISPLAY DRIVING DEVICE

(71) Applicant: SILICON WORKS CO., LTD., Daejeon-si (KR)

(72) Inventors: Young Bok Kim, Daejeon-si (KR); Young Tae Kim, Seoul (KR); Joon Ho Na, Daejeon-si (KR)

(73) Assignee: SILICON WORKS CO., LTD., Daejeon-si (KR)

( * ) Notice: Subject to any disclaimer, the term of this patent is extended or adjusted under 35 U.S.C. 154(b) by 259 days.

(21) Appl. No.: 14/837,159

(22) Filed: Aug. 27, 2015

(65) Prior Publication Data

US 2016/0063915 A1 Mar. 3, 2016

(30) Foreign Application Priority Data

Aug. 29, 2014 (KR) ..... 10-2014-0113780

(51) Int. Cl.
*G09G 5/00* (2006.01)
*G09G 3/36* (2006.01)

(52) U.S. Cl.
CPC ..... *G09G 3/3685* (2013.01); *G09G 3/3614* (2013.01); *G09G 2310/0291* (2013.01)

(58) Field of Classification Search
CPC ..... G09G 3/3614; G09G 3/3685; G09G 2310/0291
See application file for complete search history.

(56) References Cited

U.S. PATENT DOCUMENTS

2013/0241910 A1* 9/2013 Huang ..... G09G 3/3614 345/211

FOREIGN PATENT DOCUMENTS

| | | |
|---|---|---|
| KR | 10-0438784 | 7/2004 |
| KR | 10-2012-0079321 | 7/2012 |
| KR | 10-2014-0125975 | 10/2014 |
| KR | 10-2015-0002390 | 1/2015 |
| KR | 10-2015-0006160 | 1/2015 |

* cited by examiner

*Primary Examiner* — Jonathan Boyd
(74) *Attorney, Agent, or Firm* — Kile Park Reed & Houtteman PLLC

(57) ABSTRACT

An output circuit of a display driving device may include: an output buffer unit configured to buffer a pair of input signals having different polarities and output a pair of output signals; and a switching unit configured to transmit the pair of output signals to a pair of output terminals through a direct path or a cross path during an output period, and charge-share the pair of output terminals using a middle voltage of a pull-up voltage and a pull-down voltage of the output buffer unit during a charge-sharing period.

13 Claims, 8 Drawing Sheets

OUTPUT CIRCUIT AND SWITCHING CIRCUIT OF DISPLAY DRIVING DEVICE

BACKGROUND

1. Technical Field

The present disclosure relates to a display driving device, and more particularly, to an output circuit and a switching circuit of a display driving device.

2. Related Art

In many cases, a liquid crystal display (LCD) device is used as a flat panel display device. The LCD device displays a screen using an optical shutter characteristic based on the electrical characteristic of liquid crystal, and may include a source driver integrated circuit (IC), a gate driver IC, and a timing controller in order to drive liquid crystal.

A data signal has information for displaying a screen and is transmitted to the source driver IC from the timing controller, and the source driver IC provides an output signal corresponding to the data signal to a display panel.

The display panel may include an LCD panel. When the LCD panel provides only data signals having the same polarity, the LCD panel may have difficulties in forming a normal screen due to a liquid crystal driving error.

Hereafter, the source driver IC will be referred to as a display driving device. The display driving device may include a digital block and an output circuit. The digital block may process a data signal, and the output circuit may provide a signal converted by a digital-to-analog converter to the display panel. The digital block may be designed to perform a signal processing operation using a low voltage, and the output circuit may be designed to be driven by a high voltage. Since such an output circuit is driven by a high voltage, the output circuit may consume a large amount of power.

Furthermore, the output circuit may include an output buffer unit and a switching unit. The output buffer may be driven at a low voltage in order to reduce power consumption, and the switching unit may be driven at a high voltage. In this case, since the output buffer unit and the switching unit have different driving voltage ranges, the display driving device may not have a stable electrical characteristic.

SUMMARY

Various embodiments are directed to an output circuit and a switching circuit of a display driving device, which are capable of satisfying the low-power specification by excluding the use of switching elements driven in a high-voltage environment or having a withstanding voltage corresponding to a high voltage.

Also, various embodiments are directed to an output circuit and a switching circuit of a display driving device, which have a stable electrical characteristic while satisfying the low-power specification.

Also, various embodiments are directed to an output circuit and a switching circuit of a display driving device, which are capable of implementing a switching unit to have the same electrical environment as an output buffer unit, thereby preventing the occurrence of additional process cost and minimizing performance reduction.

In an embodiment, an output circuit of a display driving device may include: an output buffer unit configured to buffer a pair of input signals having different polarities and output a pair of output signals; and a switching unit configured to transmit the pair of output signals to a pair of output terminals through a direct path or a cross path during an output period, and charge-share the pair of output terminals using a middle voltage of a pull-up voltage and a pull-down voltage of the output buffer unit during a charge-sharing period.

In an embodiment, an output circuit of a display driving device may include: an output buffer unit configured to buffer a pair of input signals having different polarities and output a pair of output signals; a first switching unit configured to transmit the pair of output signals using a direct path or cross path; a second switching unit configured to transmit the pair of output signals received from the first switching unit to a pair of output terminals, and charge-share the pair of output terminals to a predetermined level when the first switching unit is disabled; and a precharge unit configured to precharge a node between the first and second switching units to the predetermined level, when the first and second switching unit are disabled.

In an embodiment, a switching circuit of a display driving circuit may include: a first switch configured to transmit an output signal of an output buffer unit; a second switch coupled in series to the first switch and configured to transmit the output signal to an output terminal; and a third switch configured to precharge a node between the first and second switches to a predetermined level, when the first and second switches are disabled.

DETAILED DESCRIPTION

Figure 1:
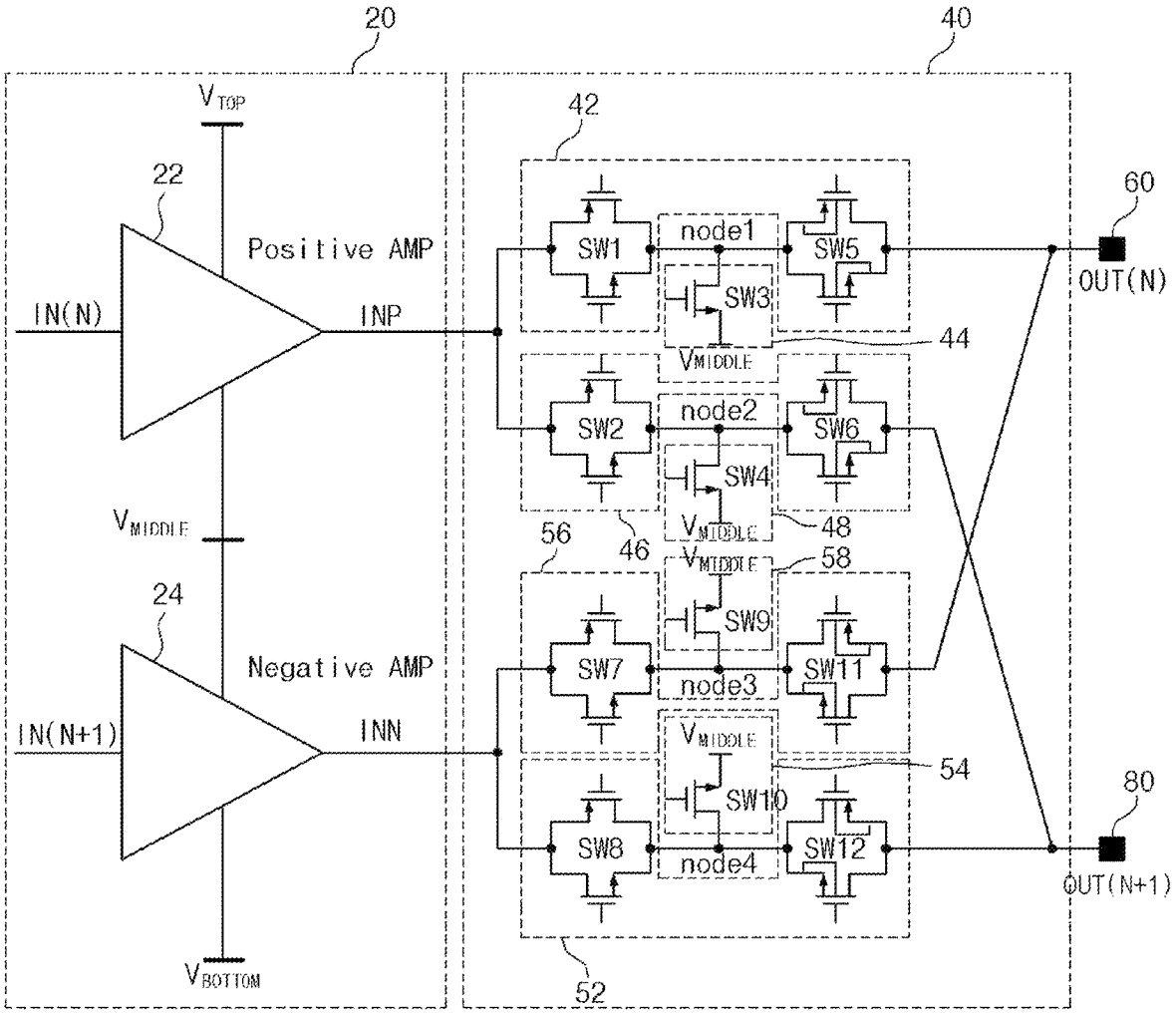
FIG. 1 is a circuit diagram illustrating an output circuit of a display driving device in accordance with an embodiment of the present invention.

Exemplary embodiments will be described below in more detail with reference to the accompanying drawings. The disclosure may, however, be embodied in different forms and should not be constructed as limited to the embodiments set forth herein. Rather, these embodiments are provided so that this disclosure will be thorough and complete, and will fully convey the scope of the disclosure to those skilled in the art. Throughout the disclosure, like reference numerals refer to like parts throughout the various figures and embodiments of the disclosure.

Various embodiments of the present invention provide an output circuit of a display driving device including a switching unit 40 which is driven using a pull-up voltage $V_{TOP}$, a pull-down voltage $V_{BOTTOM}$, and a middle voltage $V_{MIDDLE}$ of an output buffer unit 20, in order to satisfy the low-power specification. In the embodiments of the present invention, the middle voltage $V_{MIDDLE}$ may be set to an average value corresponding to the middle of the sum of the pull-up voltage $V_{TOP}$ and the pull-down voltage $V_{BOTTOM}$ which are used for driving the output buffer unit 20.

That is, the output buffer unit 20 and the switching unit 40 may be implemented with low-voltage transistors, and driven in a low-voltage environment. For example, when the pull-up voltage $V_{TOP}$ is 9V and the pull-down voltage $V_{BOTTOM}$ is 0V, the middle voltage $V_{MIDDLE}$ may be set to 4.5V. Furthermore, when the pull-up voltage $V_{TOP}$ is 4.5V and the pull-down voltage $V_{BOTTOM}$ is −4.5V, the middle voltage $V_{MIDDLE}$ may be set to a ground voltage of 0V. In this case, the output buffer unit 20 and the switching unit 40 may be driven at a low voltage of 4.5V, and the low-voltage transistors included in the output buffer unit 20 and the switching unit 40 may be designed to have a withstanding voltage corresponding to a voltage of 4.5V. In the embodiment of the present invention, the configuration in which high-voltage switches driven at a high voltage and used in the conventional display driving device are excluded will be taken as an example. At this time, the high voltage may indicate a voltage higher than the low voltage. When the low voltage is defined as 4.5V or less, the high voltage may be defined as a voltage higher than 4.5V, for example, a voltage of 9V, 18V, or 36V.

The output circuit of the display driving device in accordance with the embodiment of the present invention may serve to provide a signal converted and outputted by a digital-to-analog converter to a display panel in response to a data signal. Since the output circuit transmits a large number of output signals, the display driving device may include a large number of output circuits corresponding to the output signals. For convenience of description, FIG. 1 illustrates that the output circuit receives a pair of input signals IN(N) and IN(N+1) having different polarities and outputs signals OUT(N) and OUT(N+1) to a pair of output terminals 60 and 80. At this time, The technology using the pair of input signals IN(N) and IN(N+1) having different polarities may indicate that a source driver IC alternately provides positive and negative output signals to the same line of a liquid crystal display panel, in order to suppress liquid crystal sticking. In FIG. 1, INP and INN represent signals which are buffered and outputted through the output buffer unit 20 having received the pair of input signals IN(N) and IN(N+1), and OUT(N) and OUT(N+1) represent signals which are transmitted to the pair of output terminals 60 and 80 through the switching unit 40 having received the output signals INP and INN.

FIG. 1 is a circuit diagram illustrating an output circuit of a display driving device in accordance with an embodiment of the present invention.

Referring to FIG. 1, the output circuit of the display driving device in accordance with the embodiment of the present invention includes the output buffer unit 20 and the switching unit 40. The output buffer unit 20 buffers a pair of input signals IN(N) and IN(N+1) having different polarities and outputs a pair of output signals INP and INN.

The switching unit 40 transmits the output signals INP and INN of the output buffer unit 20 as signals OUT(N) and OUT(N+1) to the pair of output terminals 60 and 80 through a direct path or cross path at an output period. Furthermore, the switching unit 40 charge-shares the output terminals 60 and 80 using a middle voltage $V_{MIDDLE}$ between a pull-up voltage $V_{TOP}$ and a pull-down voltage $V_{BOTTOM}$ of the output buffer unit 20 at a charge-sharing period between the repeated output periods.

The direct path indicates a path through which the positive output signal INP of the output buffer unit 20 is transmitted to the output terminal 60 through switches SW1 and SW5 of the switching unit 40, and the negative output signal INN of the output buffer unit 20 is transmitted to the output terminal 80 through switches SW8 and SW12 of the switching unit 40. The cross path indicates a path through which the positive output signal INP of the output buffer unit 20 is transmitted to the output terminal 80 through switches SW2 and SW6 of the switching unit 40, and the negative output signal INN of the output buffer unit 20 is transmitted to the output terminal 60 through switches SW7 and SW11 of the switching unit 40. That is, the direct path indicates a path through which the output signals INP and INN are transmitted to the corresponding output terminals 60 and 80, and the cross path indicates a path through which the output signals INP and INN are transmitted to the adjacent output terminals 60 and 80.

The switching unit 40 precharges nodes node2 and node3 on the cross path to the middle voltage $V_{MIDDLE}$ while the output signals INP and INN of the output buffer unit 20 are transmitted to the output terminals 60 and 80 through the direct path, and precharges nodes node1 and node4 on the direct path to the middle voltage $V_{MIDDLE}$ while the output signals INP and INN of the output buffer unit 20 are transmitted through the cross path.

The switching unit 40 includes switches using transistors having a withstanding voltage corresponding to the low voltage. The switching unit 40 is driven in the range of the pull-up voltage $V_{TOP}$ and the middle voltage $V_{MIDDLE}$ or the middle voltage $V_{MIDDLE}$ and the pull-down voltage $V_{BOTTOM}$, which are used for driving the output buffer unit 20. That is, the switching unit 40 is configured to be driven in the same electrical environment as the output buffer unit 20.

Specifically, the switching unit 40 includes first switching circuits 42 and 52, second switching circuits 46 and 56, third switching circuits 48 and 58, and fourth switching circuits 44 and 54. The first switching circuits 42 and 52 provide the direct path. The second switching circuits 46 and 56 provides the cross path. The third switching circuits 48 and 58 precharges the nodes node2 and node3 of the second switching circuits 46 and 56 to the middle voltage $V_{MIDDLE}$, the second switching circuits 46 and 56 being disabled when the first switching circuits 42 and 52 are enabled. The fourth switching circuits 44 and 54 precharges the nodes node1 and node4 of the first switching circuits 42 and 52 to the middle voltage $V_{MIDDLE}$, the first switching circuits 42 and 52 being disabled when the second switching circuits 46 and 56 are enabled.

The first switching circuits 42 and 52 include first switches SW1 and SW8 and second switches SW5 and SW12, which are coupled in series to each other, respectively. The second switching circuits 46 and 56 include third switches SW2 and SW6 and fourth switches SW7 and SW11, which are coupled in series to each other, respectively. The third switching circuits 48 and 58 precharge the nodes node2 and node3 between the third switches SW2 and SW6 and the fourth switches SW7 and SW11 to the middle voltage $V_{MIDDLE}$, the third switches SW2 and SW6 and the fourth switches SW7 and SW11 being disabled when the first switching circuits 42 and 52 are enabled. The fourth switching circuits 44 and 54 precharge the nodes node1 and node4 between the first switches SW1 and SW8 and the second switches SW5 and SW12 to the middle voltage $V_{MIDDLE}$, the first switches SW1 and SW8 and the second switches SW5 and SW12 being disabled when the second switching circuits 46 and 56 are enabled.

Figure 2:
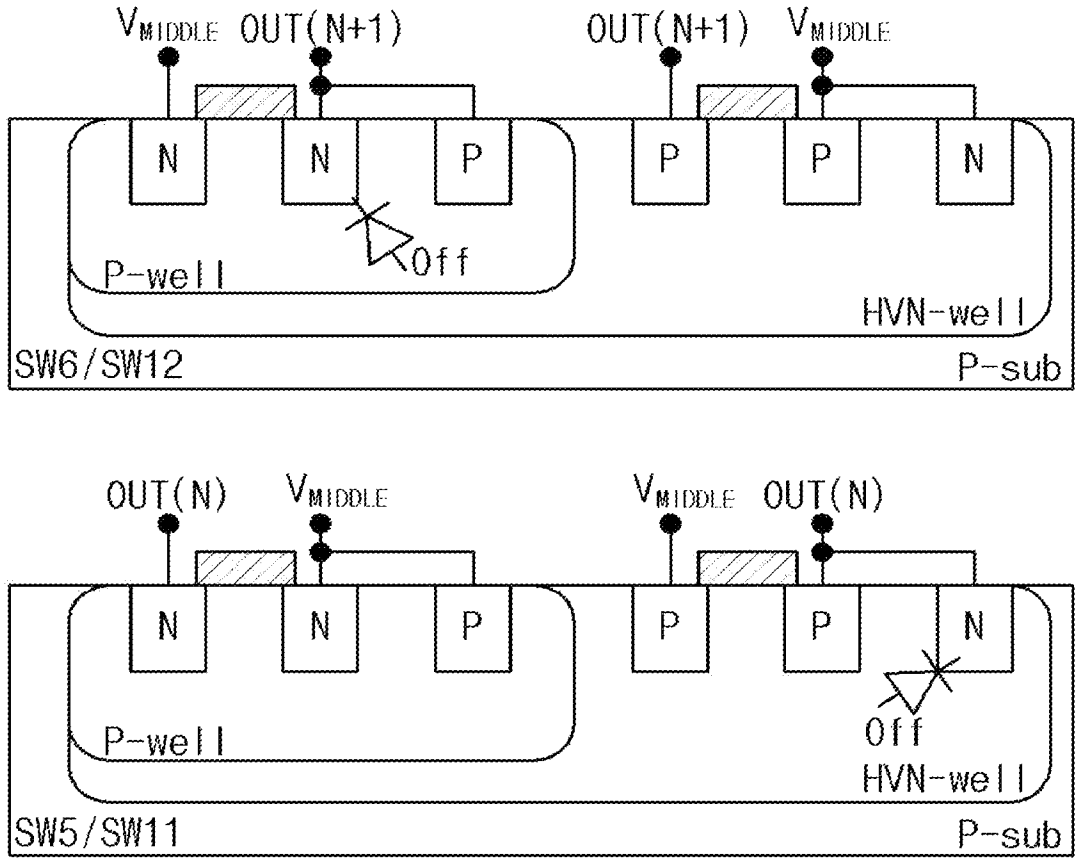
FIG. 2 is a cross-sectional view of switches SW6, SW12, SW5, and SW11 included in a switching unit of FIG. 1.

FIG. 2 is a cross-sectional view of the switches SW6, SW12, SW5, and SW11 included in the switching unit of FIG. 1.

Referring to FIG. 2, the second switches SW5 and SW11 and the fourth switches SW6 and SW12 include a PMOS transistor and an NMOS transistor of which the source and body are coupled to each other. This is in order to drive drain-body-source voltages in the range of the allowable voltage of the transistors, thereby preventing charges from the nodes node1 to node4 from flowing into the output terminals 60 and 80, the nodes node1 to node4 being precharged during the precharge operations of the third switching circuits 48 and 58 and the fourth switching circuits 44 and 54.

The second switches SW5 and SW11 and the fourth switches SW6 and SW12 are configured to selectively turn on the PMOS transistor or the NMOS transistor in response to the polarity state of an output period during a charge-sharing period. Specifically, the PMOS transistor or the NMOS transistor is selectively turned on in response to whether the charge-sharing period is a charge-sharing period after a direct output period Direct Path or a cross output period Cross Path.

In the present embodiment, the NMOS transistor is turned on at the charge-sharing period after the direct output period, and the PMOS transistor is turned on at the charge-sharing period after the cross output period. However, the PMOS transistor may be turned on at the charge-sharing period after the direct output period, and the NMOS transistor may be turned on at the charge-sharing period after the cross output period.

Referring to FIG. 1, an output circuit of a display driving device in accordance with another embodiment of the present invention may include the output buffer unit 20, first switching units 42 and 52, second switching units 46 and 56, and precharge units 44, 48, 58, and 54.

The output buffer unit 20 buffers a pair of input signals IN(N) and IN(N+1) having different polarities and outputs a pair of output signals INP and INN. The first switching units 42 and 52 transmit signals OUT(N) and OUT(N+1) to the pair of output terminals 60 and 80 through the direct path or cross path. The second switching units 46 and 56 charge-share the output terminals 60 and 80 to the middle voltage $V_{MIDDLE}$ when the first switching units 42 and 52 are disabled. The precharge units 44, 48, 58, and 54 precharge nodes node1, node2, node3, and node4 between the first switching units 42 and 52 and the second switching units 46 and 56, respectively, when the first switching units 42 and 52 and the second switching units 46 and 56 are disabled.

The precharge units 44, 48, 58, and 54 of the first switching units 42 and 52 and the second switching units 46 and 56 include switches using transistors having a withstanding voltage corresponding to a low voltage. In order to satisfy the low-power specification and have a stable electrical environment, the precharge units 44, 48, 58, and 54 of the first switching units 42 and 52 and the second switching units 46 and 56 are driven in the range of the pull-up voltage $V_{TOP}$ and the middle voltage $V_{MIDDLE}$ or the middle voltage $V_{MIDDLE}$ and the pull-down voltage $V_{BOTTOM}$, which are used for driving the output buffer unit 20. That is, the precharge units 44, 48, 58, and 54 of the first switching units 42 and 52 and the second switching units 46 and 56 are implemented with the same low-voltage transistors as those of the output buffer unit 20.

Referring to FIG. 1, the switching circuit of the display driving device in accordance with the embodiment of the present invention includes a first switch SW1, a second switch SW5, and a third switch SW3. The first switch SW1 transmits an output signal INP of the output buffer unit 20. The second switch SW2 is coupled in series to the first switch SW1 and transmits an output signal to the output terminal 60. The third switch SW3 precharges the node node1 between the first switch SW1 and the second switch SW5 to the middle voltage $V_{MIDDLE}$ when the first switch SW1 and the second switch SW5 are disabled.

The second switch SW5 and the third switch SW3 charge-share the output terminal 60 to the middle voltage $V_{MIDDLE}$ such that the level of the output terminal 60 is equalized to the level of the adjacent output terminal 80, when the first switch SW1 is disabled. The first switch SW1, the second switch SW5, and the third switch SW3 include transistors having a withstanding voltage corresponding to a low voltage, in order to satisfy the low-power specification. The first switch SW1, the second switch SW5, and the third switch SW3 are driven in the range of the pull-up voltage $V_{TOP}$ and the middle voltage $V_{MIDDLE}$ or the middle voltage $V_{MIDDLE}$ and the pull-down voltage $V_{BOTTOM}$, which are used for driving the output buffer unit 20.

In the embodiment of the present invention, the configuration of the switching circuit for the positive output signal INP of the output buffer unit 20 has been described. However, a switching circuit corresponding to the negative output signal INN may be included in the scope of the present invention.

Figure 7:
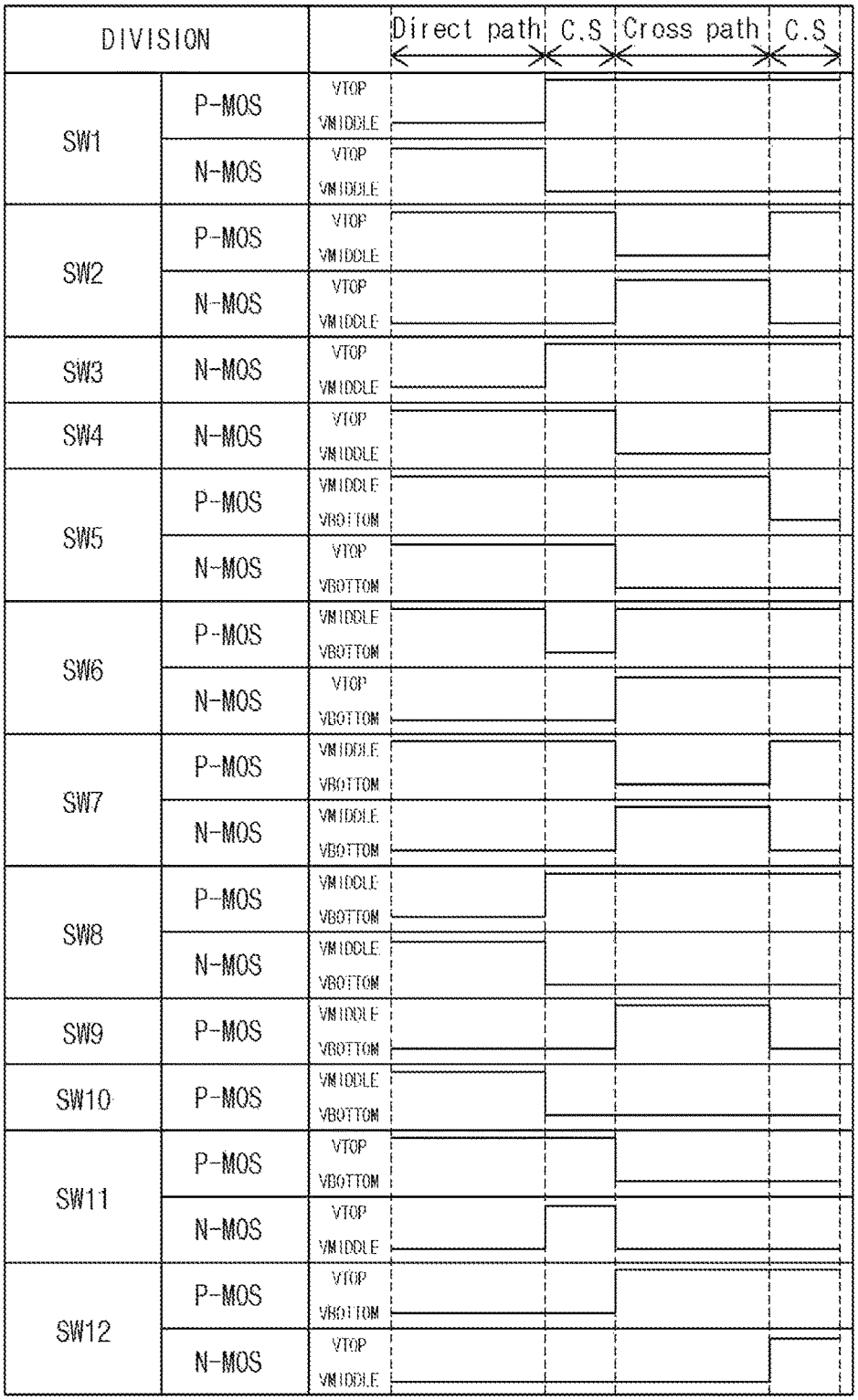
FIG. 7 is a timing diagram illustrating control signals for controlling the operation of the switching unit of FIG. 1.
Figure 8:
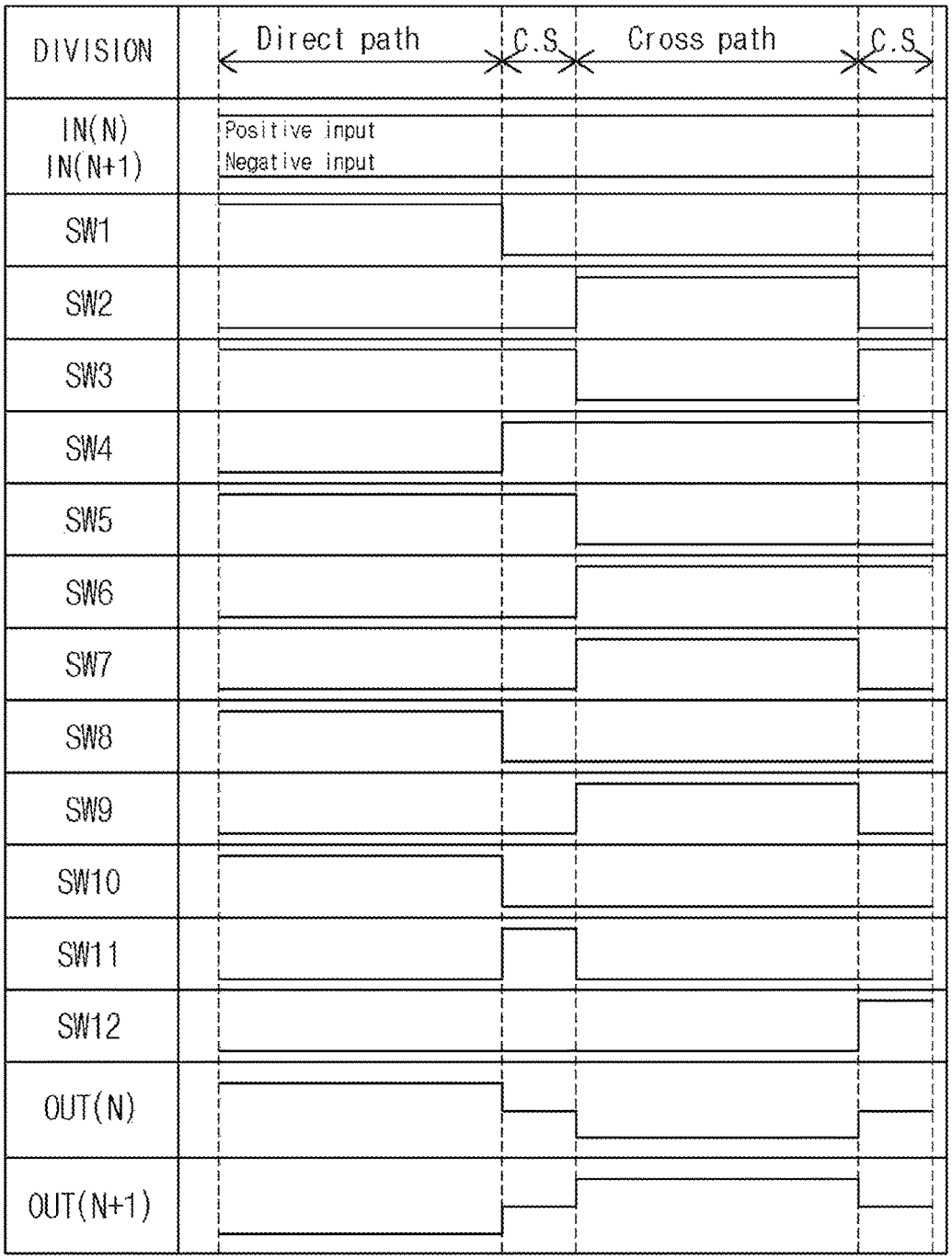
FIG. 8 is a timing diagram for describing the operation process of FIG. 1.

FIGS. 3 to 6 are circuit diagrams for describing the operation process of FIG. 1. FIG. 7 is a timing diagram illustrating control signals for controlling the operation of the switching unit of FIG. 1. FIG. 8 is a timing diagram for describing the operation process of FIG. 1.

The output circuit of the display driving device in accordance with the embodiment of the present invention may repeat the direct output period Direct Path, the charge-sharing period C.S, the cross output period Cross Path, and the charge-sharing period C.S.

Figure 3:
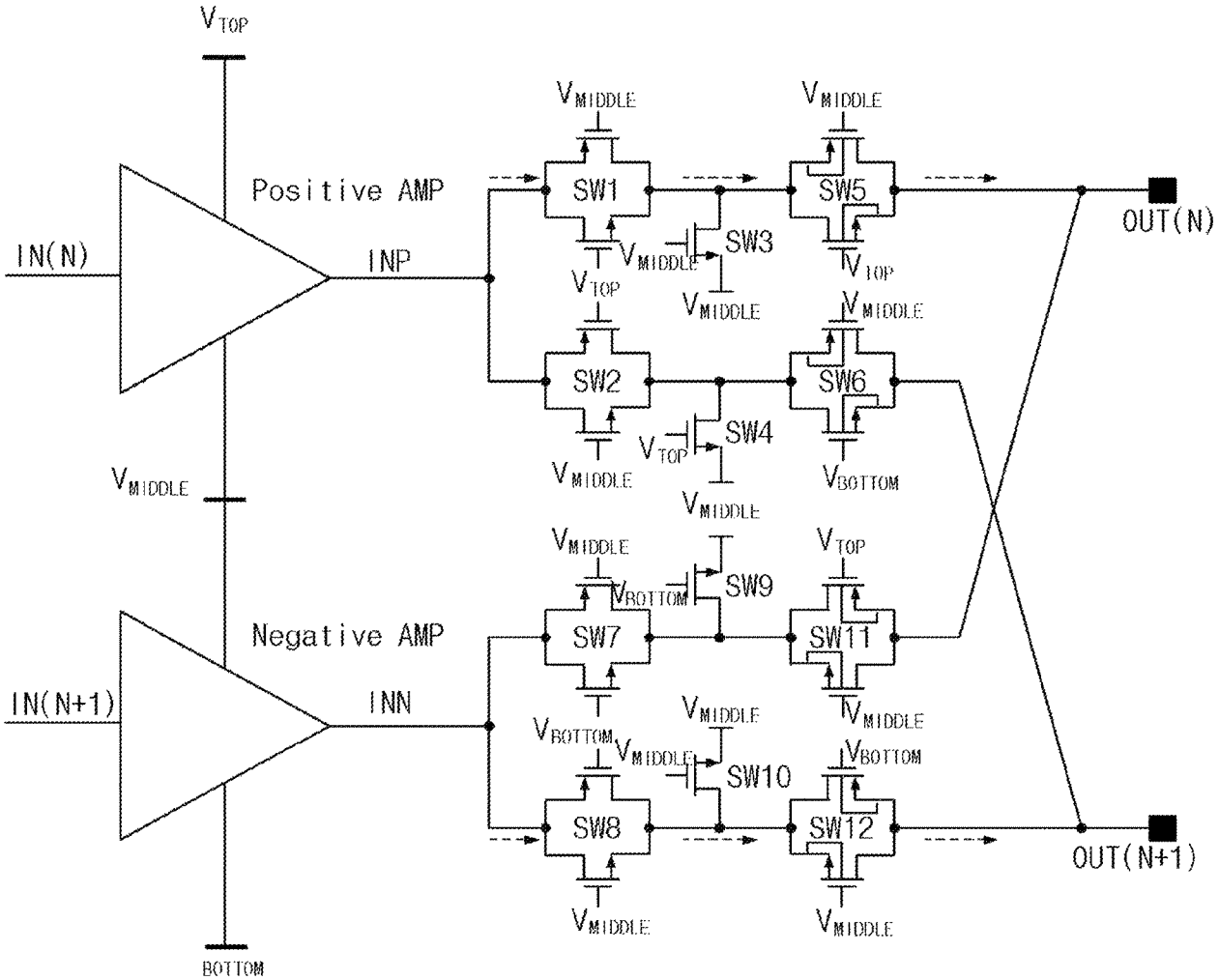
FIGS. 3 to 6 are circuit diagrams for describing the operation process of FIG. 1.
Figure 4:
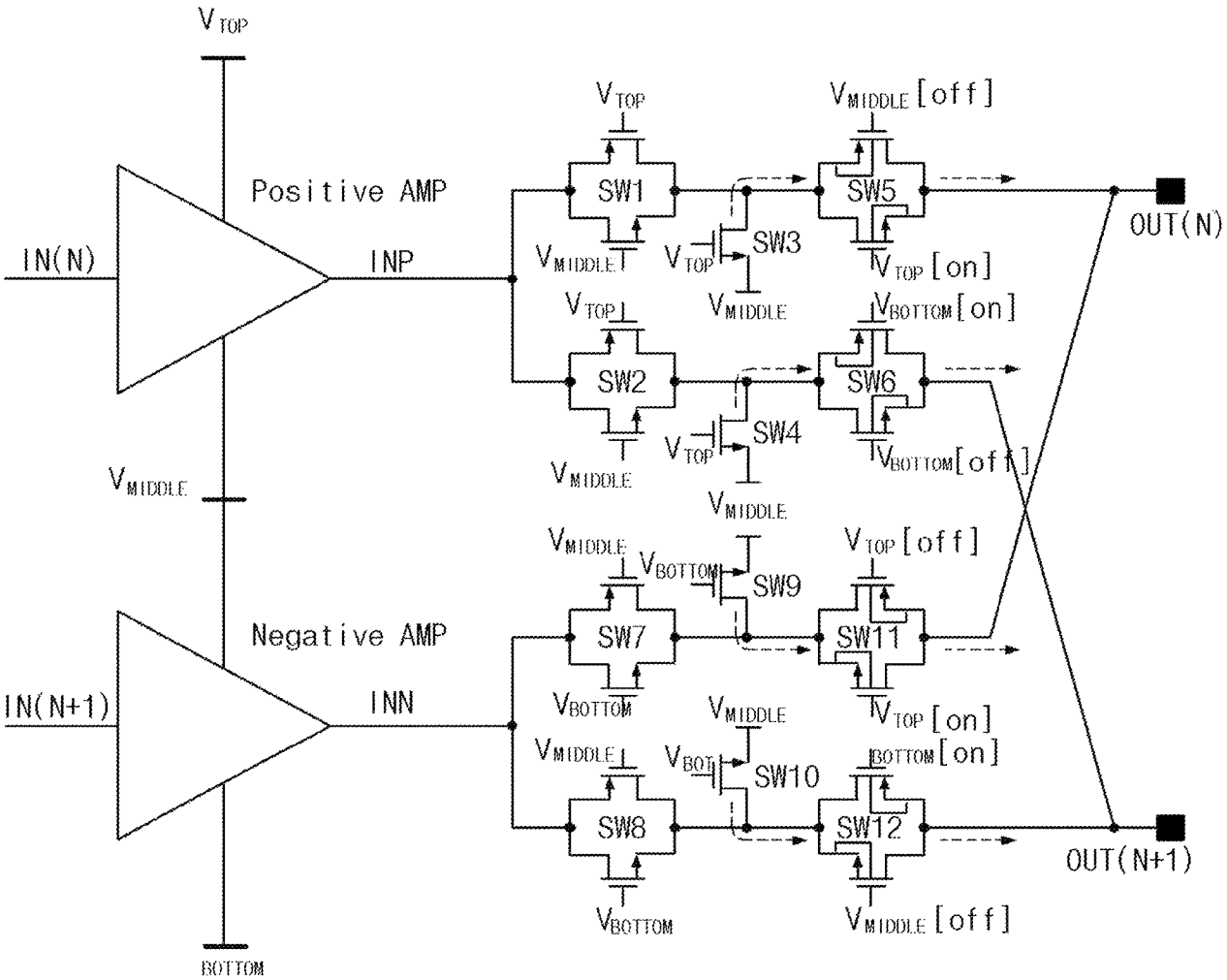
Figure 5:
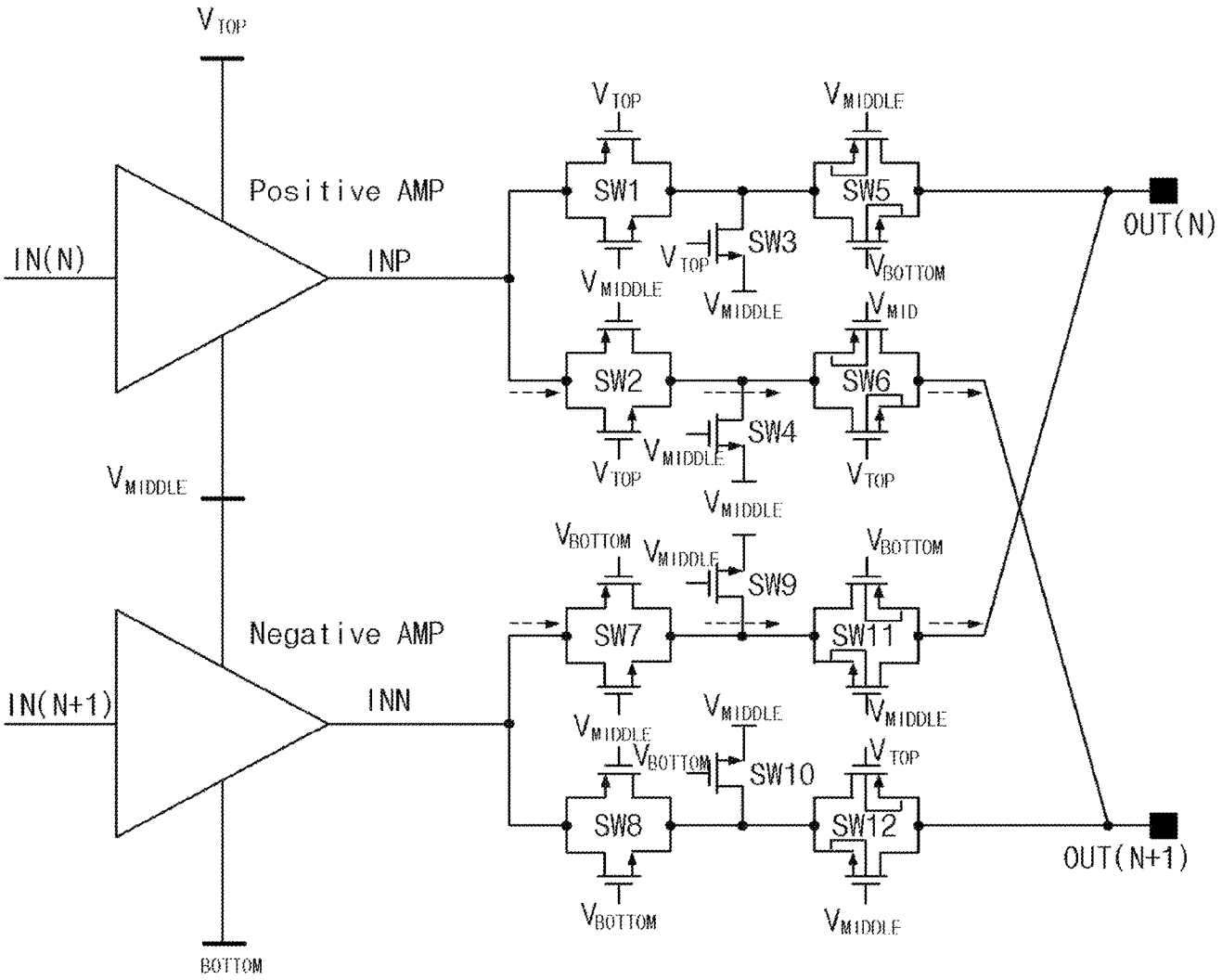
Figure 6:
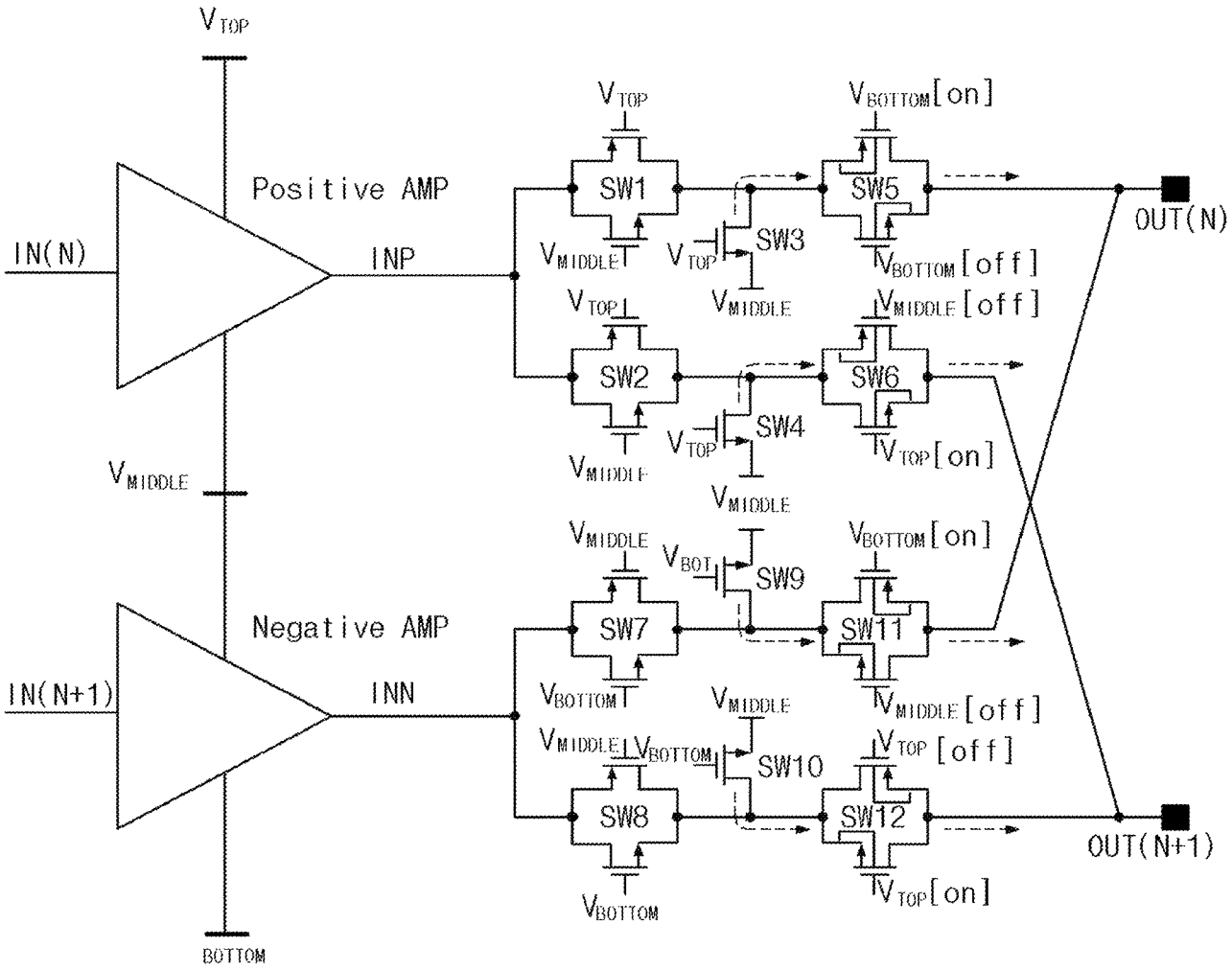

FIG. 3 illustrates the operation of the direct output period Direct Path, FIG. 4 illustrates the operation of the charge-sharing period C.S after the direct output period Direct Path, FIG. 5 illustrates the operation of the cross output period Cross Path, and FIG. 6 illustrate the operation of the charge-sharing period C.S after the cross output period Cross Path. FIG. 7 illustrates a control signal at the direct output period Direct Path, a control signal at the charge-sharing period C.S after the direct output period Direct Path, a control signal at the cross output period Cross Path, and a control signal at the charge-sharing period C.S after the cross output period Cross Path. FIG. 8 is a timing diagram based on control signals applied to the NMOS transistors of the switches SW1 to SW8, SW11, and SW12 and the PMOS transistors of the switches SW9 and SW10 in FIG. 7. Referring to FIGS. 3 to 8, the output buffer unit 20 buffers a pair of input signals IN(N) and IN(N+1) having different polarities, and outputs a pair of output signals INP and INN.

First, during the direct output period Direct Path using the direct path, a control signal (refer to FIGS. 3 and 7) is applied to the respective switches SW1 to SW12 of the switching unit 40.

The control signal is also driven in the range of the pull-up voltage $V_{TOP}$ and the middle voltage $V_{MIDDLE}$ or the middle voltage $V_{MIDDLE}$ and the pull-down voltage $V_{BOTTOM}$, which are used for driving the output buffer unit 20.

Then, the switching unit 40 transmits output signals INP and INN to the pair of the output terminals 60 and 80 through the direct path in response to the control signal at the output period Direct Path using the direct path.

Specifically, in response to the control signal at the direct output path Direct Path, the first switching circuits 42 and 52 of the switching unit 40 are enabled, and the second switching circuits 46 and 56 are disabled. At this time, the first switching circuits 42 and 52 transmit the output signals INP and INN as signals OUT(N) and OUT(N+1) to the pair of output terminals 60 and 80 through the direct path, and the third switching circuits 48 and 58 precharge the nodes node2 and node3 of the disabled second switching circuits 46 and 56 to the middle voltage $V_{MIDDLE}$.

Subsequently, during the charge-sharing period C.S, a control signal (refer to FIGS. 4 and 7) is applied to the respective switches SW1 to SW12 of the switching unit 40. Then, as illustrated in FIG. 8, the switches SW1, SW2, SW7, and SW8 of the switching unit 40 are turned off, and the switches SW3, SW4, SW5, SW6, SW9, SW10, SW11, and SW12 are turned on. At this time, the NMOS transistors of the switches SW5, SW11, SW6, and SW12 are turned on, and the PMOS transistors are turned off. That is, the switching unit 40 charge-shares the output terminals 60 and 80 to the middle voltage $V_{MIDDLE}$ of the pull-up voltage $V_{TOP}$ and the pull-down voltage $V_{BOTTOM}$ of the output buffer unit 20 in response to the control signal at the charge-sharing period C.S.

Subsequently, during the cross output period Cross Path, a control signal (refer to FIGS. 5 and 7) is applied to the respective switches SW1 to SW12 of the switching unit 40. Then, in response to the control signal at the cross output path Cross Path, the second switching circuits 46 and 56 of the switching unit 40 are enabled, and the first switching circuits 42 and 52 are disabled.

At this time, the second switching circuits 46 and 56 transmit the signals INP and INN as the output signals OUT(N) and OUT(N+1) to the pair of output terminals 60 and 80 through the cross path, and the fourth switching circuits 44 and 54 precharge the nodes node1 and node4 of the disabled first switching circuits 42 and 52 to the middle voltage $V_{MIDDLE}$.

Subsequently, during the charge-sharing period C.S, a control signal (refer to FIGS. 6 and 7) is applied to the respective switches SW1 to SW12 of the switching unit 40. Then, as illustrated in FIG. 8, the switches SW1, SW2, SW7, and SW8 of the switching unit 40 are turned off, and the switches SW3, SW4, SW5, SW6, SW9, SW10, SW11, and SW12 are turned on, in response to the control signal at the charge-sharing period C.S.

At this time, the PMOS transistors of the switches SW5, SW11, SW6, and SW12 are turned on, and the NMOS transistors are turned off. That is, the switching unit 40 may charge-share the output terminals 60 and 80 using the middle voltage $V_{MIDDLE}$ of the pull-up voltage $V_{TOP}$ and the pull-down voltage $V_{BOTTOM}$ of the output buffer unit 20, during the charge-sharing period C.S.

In short, the output circuit of the display driving device in accordance with the embodiment of the present invention repeats the direct output period Direct Path, the charge-sharing period C.S, the cross output period Cross Path, and the charge-sharing period C.S in the range of the pull-up voltage $V_{TOP}$ and the middle voltage $V_{MIDDLE}$ or the middle voltage $V_{MIDDLE}$ and the pull-down voltage $V_{BOTTOM}$, which are used for driving the output buffer unit 20.

As described above, the output circuit and the switching circuit of the display driving device in accordance with the embodiment of the present invention implement the switching unit using low-voltage transistors, without using switching elements which are driven in a high-voltage environment or have a withstanding voltage corresponding to a high voltage, thereby satisfying the low-power specification and having a stable electrical characteristic. Furthermore, the output circuit and the switching circuit of the display driving device implement the switching unit using the same low-voltage transistors as those of the output buffer unit, thereby prevent the occurrence of additional process cost and minimizing performance reduction.

While various embodiments have been described above, it will be understood to those skilled in the art that the embodiments described are by way of example only. Accordingly, the disclosure described herein should not be limited based on the described embodiments.

What is claimed is:

1. An output circuit of a display driving device, comprising:

an output buffer unit configured to buffer a pair of first and second input signals having different polarities and output a pair of first and second output signals; and a switching unit configured to transmit the pair of first and second output signals to a pair of first and second output terminals through a direct path or a cross path during an output period, and charge-share the pair of output terminals using a middle voltage of a pull-up voltage and a pull-down voltage of the output buffer unit during a charge-sharing period, wherein the switching unit comprises:

a first switching circuit configured to transmit the first output signal to the first terminal through first and second switches coupled in series;

a second switching circuit configured to transmit the first output signal to the second terminal through third and fourth switches coupled in series;

a third switching circuit configured to precharge a node between the third and fourth switches to the middle voltage at the output period, the third and fourth switches being disabled when the first and second switches transmit the first output signal to the first terminal; and a fourth switching circuit configured to precharge a node between the first and second switches to the middle voltage at the output period, the first and second switches being disabled when the third and fourth switches transmit the first output signal to the second terminal.

2. The output circuit of claim 1, wherein the switching unit precharges a specific node of the direct path or the cross path which is disabled at the output period to the middle voltage.

3. The output circuit of claim 1, wherein the middle voltage is set to an average value of the pull-up voltage and the pull-down voltage, which are used for driving the output buffer unit.

4. The output circuit of claim 1, wherein the switching unit comprises switches using transistors having a withstanding voltage corresponding to a low voltage, and is configured to drive in the range of the pull-up voltage and the middle voltage or the middle voltage and the pull-down voltage, which are used for driving the output buffer unit.

5. The output circuit of claim 1, wherein the second switch comprises a first PMOS transistor and a first NMOS transistor, each of which has a source and body coupled to each other, and the fourth switch comprises a second PMOS transistor and a second NMOS transistor, each of which has a source and body coupled to each other.

6. The output circuit of claim 1, wherein the second switch comprises a first PMOS transistor and a first NMOS transistor, and the fourth switch comprises a second PMOS transistor and a second NMOS transistor, and the first and second PMOS transistors or the first and second NMOS transistors are configured to selectively turn on in response to the polarity state of the output period during the charge-sharing period.

7. An output circuit of a display driving device, comprising:

an output buffer unit configured to buffer a pair of first and second input signals having different polarities and output a pair of first and second output signals;

a first switching unit configured to transmit the pair of first and second output signals using a direct path or cross path during an output period;

a second switching unit configured to transmit the pair of first and second output signals received from the first switching unit to a pair of first and second output terminals, and charge-share the pair of output terminals to a middle voltage of a pull-up voltage and a pull-down voltage of the output buffer when the first switching unit is disabled; and a precharge unit configured to precharge a node between the first and second switching units to the middle voltage, wherein the first switching unit comprises a first switch providing the direct path and a third switch providing the cross path, wherein the second switching unit comprises a second switch serially coupled to the first switch and a fourth switch serially coupled to the third switch, wherein the first and second switches transmit the first output signal to the first output terminal, the third and fourth switches transmit the first output signal to the second output terminal, and wherein the precharge unit precharges a node between the third and fourth switches to the middle voltage at the output period, the third and fourth switches being disabled when the first and second switches transmit the first output signal to the first terminal, and precharges a node between the first and second switches to the middle voltage at the output period, the first and second switches being disabled when the third and fourth switches transmit the first output signal to the second terminal.

8. The output circuit of claim 7, wherein the middle voltage is set to an average value of the pull-up voltage and the pull-down voltage of the output buffer unit.

9. The output circuit of claim 7, wherein the first switching unit, the second switching unit, and the precharge unit comprise switches using transistors having a withstanding voltage corresponding to a low voltage, and are configured to drive in the range of a pull-up voltage and a middle voltage or the middle voltage and a pull-down voltage, which are used for driving the output buffer unit.

10. A switching circuit of a display driving circuit, comprising:

first and second switches serially coupled and configured to transmit an output signal of an output buffer unit to a first output terminal through a direct path during an output period;

third and fourth switches serially connected configured to transmit the output signal of the output buffer unit to a second output terminal through a cross path during the output period;

a fifth switch configured to precharge a node between the third and fourth switches to a middle voltage of a pull-up voltage and a pull-down voltage of the output buffer unit at the output period, the third and fourth switches being disabled when the first and second switches transmit the output signal to the first terminal, and a sixth switch configured to precharge a node between the first and second switches to the middle voltage at the output period, the first and second switches being disabled when the third and fourth switches transmit the output signal to the second terminal.

11. The output circuit of claim 10, wherein the second and third switches are configured to charge-share the first output terminal to the middle voltage when the first switch is disabled.

12. The output circuit of claim 10, wherein the middle voltage is set to an average voltage of the pull-up voltage and the pull-down voltage of the output buffer unit.

13. The output circuit of claim 10, wherein the first to sixth switches comprise transistors having a withstanding voltage corresponding to a low voltage, and are configured to drive in the range of a pull-up voltage and a middle voltage or the middle voltage and a pull-down voltage, which are used for driving the output buffer unit.

* * * * *